United States Patent [19]

Bergquist

[11] Patent Number: 4,942,711

[45] Date of Patent: Jul. 24, 1990

[54] OUTER WALLS OR ROOFS

[75] Inventor: Dan Bergquist, Nässjö , Sweden

[73] Assignee: Swedal-Systems HB, Nässjö , Sweden

[21] Appl. No.: 298,486

[22] Filed: Jan. 18, 1989

[30] Foreign Application Priority Data

Jan. 19, 1988 [SE] Sweden ..... 8800155

[51] Int. Cl.[5] ..... E04B 1/62

[52] U.S. Cl. ..... 52/397; 52/398; 52/467

[58] Field of Search ..... 52/398, 397, 466, 467, 52/468, 400

[56] References Cited

U.S. PATENT DOCUMENTS

| | | | |
|---|---|---|---|
| 1,016,118 | 1/1912 | Wendler | 52/467 X |
| 1,156,981 | 10/1915 | Crocker | 52/467 X |
| 2,764,788 | 10/1956 | Macormack | 52/468 |
| 2,966,707 | 1/1961 | Ellis | 52/398 X |
| 3,127,639 | 4/1964 | Hammitt et al. | 52/397 |
| 4,031,680 | 6/1977 | Stoakes | 52/468 X |
| 4,092,812 | 6/1978 | Dashner et al. | 52/400 X |
| 4,418,506 | 12/1983 | Weber et al. | 52/398 X |
| 4,691,489 | 9/1987 | Shea | 52/398 X |

FOREIGN PATENT DOCUMENTS

| | | | |
|---|---|---|---|
| 530083 | 7/1931 | Fed. Rep. of Germany | 52/397 |
| 1419408 | 12/1975 | United Kingdom | 52/397 |

*Primary Examiner*—Carl D. Friedman

*Attorney, Agent, or Firm*—Cohen, Pontani & Lieberman

[57] ABSTRACT

This invention relates to improvements in such outer walls and roofs as are subjected to rain and moisture and which are constructed as an inner set of metal sections (1A, 1B), that support mutually adjacent glass panels (2, 3) held to the inner sections (1A, 1B) by metallic cover strips (4A, 4B). These strips, which are screwed into the inner sections (1), frame the panels and define junction or intersection points between themselves. To eliminate leakage through the roof or wall to the greatest possible extent the inner sections (1A, 1B) are, at least within the area of the retaining screws of the cover strips (4A, 4B), covered by at least one layer of an optionally fabric-reinforced foil (11, 12) of rubber, plastic or a similar ductile and liquid-tight material.

5 Claims, 2 Drawing Sheets

FIG. 2
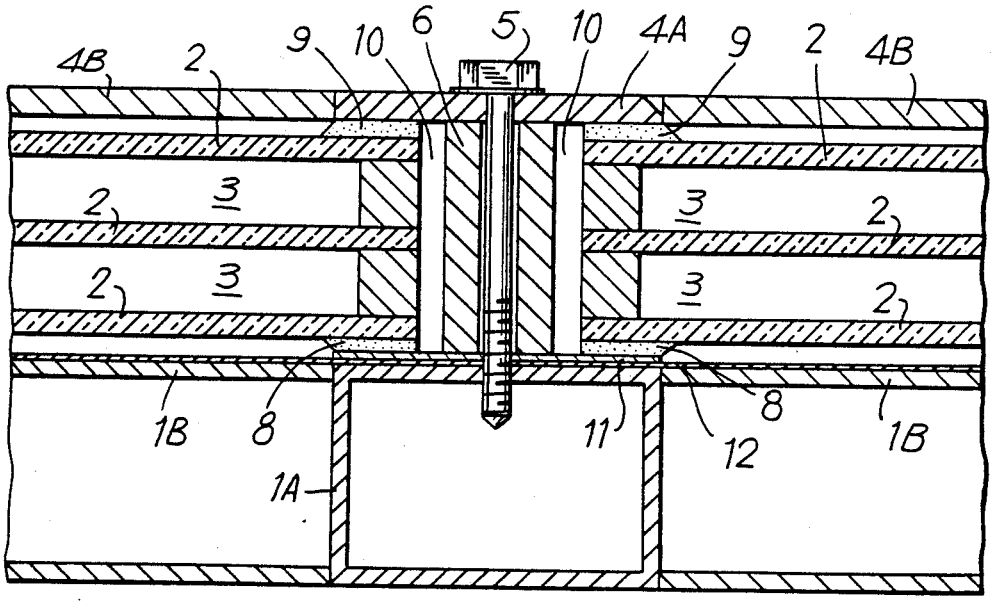
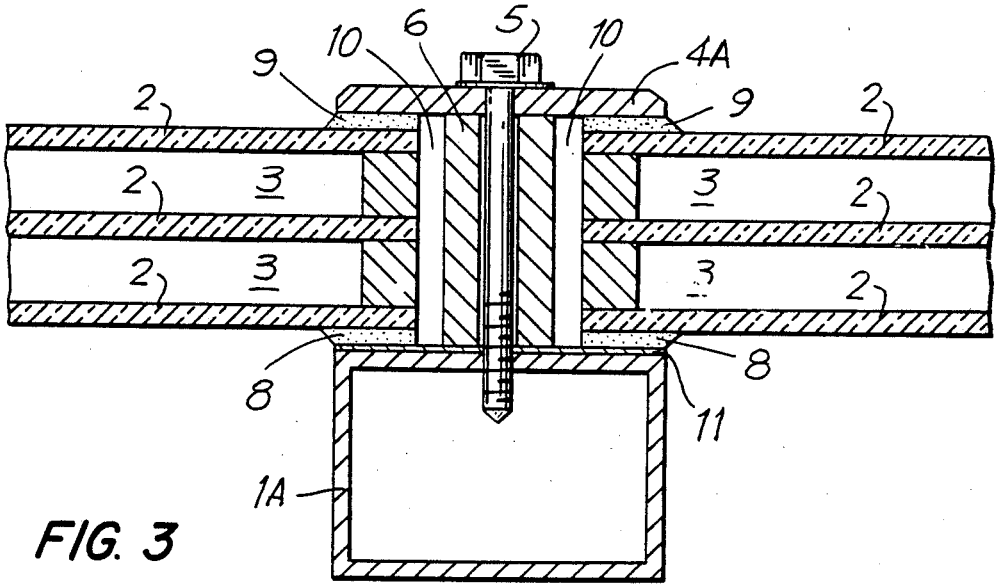
FIG. 3

OUTER WALLS OR ROOFS

BACKGROUND OF THE INVENTION

The present invention relates generally to outer wall and roof construction systems, particularly to an improved wall construction system having a plurality of wall panels supported by a frame system, comprising an internal frame member for providing support for adjacently disposed wall panels, the frame member having a surface that defines a plane, an external cover member mounted on the frame member for securing the wall panels between the cover and frame member and having at least one centrally located fastener hole defined in the cover member, a fastener for attaching the cover to the frame member, and a sheet-like sealing member disposed in overlying supported relation on and substantially parallel to the plane of the frame member surface.

Systems of this kind are utilized, inter alia, in glass roofs and glass walls which have become more and more common in the building field. In such constructions great problems arise due to leakage, particularly in glass roofs. Rain and melting snow flow uncontrolledly into and through the structure. Such leakage is difficult to trace and expensive to remedy. Exterior sealing devices are good, but sunshine, weather and wind wear or erode the sealing material when it is exposed to the elements. Movement of the aluminum sections forming the structure due to changes in temperature, yielding of the building framework and so on also cause leakage. Furthermore, these structures are also internally subjected to condensation of water from circulating air, since the structures have vented or aerated at the edges of the isolating glass; otherwise the guarantee of the manufacturers of the isolating glass will not be valid.

In an attempt to remedy these drawbacks one has in some instances in certain glass roof constructions internally provided the aluminum sections with "suspension cuts" on the underside of the sections for collecting leakage water; problems then arise in junctions and outlets.

Another attempt to solve these leakage problems is disclosed in U.S. Pat. No. 3,844,087, which relates to a glass roof with lead-away-channels for condensate at the upper portions of the purlings and rafters made of aluminum sections, adjacent the glass panels supported thereby.

Also in these known constructions sealing problems arise when the sections move mutually, and in addition it is difficult to provide durable seals at junctions and intersections due to of the cuts provided in the sections.

Neither has the application of a sealing compound of rubber gaskets between the section ends and adjoining sections, which has also been tried, given satisfactory results.

SUMMARY OF THE INVENTION

In view of the above circumstances, the principal object of the invention is to provide a system of the kind in question and wherein durable sealing against rain, snow and other external moisture is accomplished in glass roofs, glass walls and similar constructions. This object is achieved by the wall construction system of the present invention which comprises an internal frame member for providing support for adjacently disposed wall panels, the frame member having a surface that defines a plane, an external cover member mounted on the frame member for securing the wall panels between the cover and frame member and having at least one centrally located fastener hole defined in the cover member, a fastener for attaching the cover to the frame member, and a sheet-like sealing member disposed in overlying supported relation on and substantially parallel to the plane of the frame member surface.

Accordingly, the sealing device in accordance with this invention is located in the interior of the structure where it is not directly reached by the outside weather, and the sealing device is so designed that the aluminum structure can move without damaging the seals.

BRIEF DESCRIPTION OF THE DRAWINGS

Further features and advantages of the system according to the invention will become apparent from the following description and the annexed drawings which diagrammatically and a non-limiting example illustrate a preferred embodiment of the invention.

FIG. 2 is a sectional view along the line II—II in FIG. 1.

FIG. 3 is a sectional view along the line III—III of FIG. 1.

DETAILED DESCRIPTION OF THE PREFERRED EMBODIMENT

Figure 1:
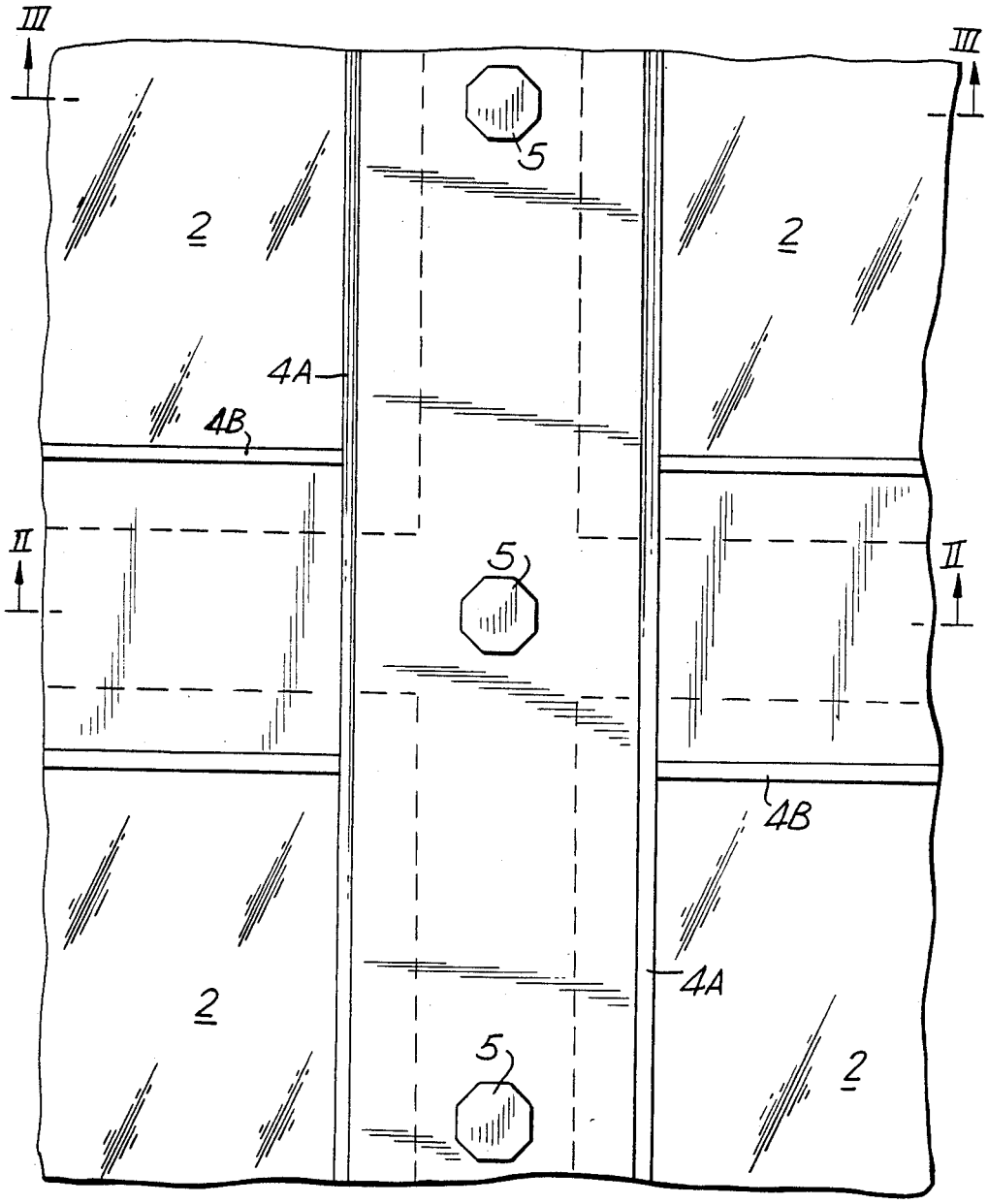
FIG. 1 is a partial plan view of a glass roof or a glass wall, as from above or from the outside, respectively.

In the drawings, 1A and 1B designate inner, optionally supporting, beams in the shape of box girders of aluminum or the like, which have a rectangular cross section. The two sets of inner sections 1A and 1B, respectively, together intersections in which one end of an inner section 1B abuts a longitudinal form side of another inner section 1A, although the invention can, of course, also be applied to junctions of the type which will for instance arise when one of the profiles 1B in FIG. 2 is omitted.

The inner beams or profiles 1A, 1B support, where an outer glass wall or a glass roof is concerned, triple pane glass windows, which comprise three glass sheets 2 that are hermetically tightly interconnected by means of edge lists 3. The triple pane windows 2, 3 are held to the inner sections 1A, 1B by means of outer sections in the form of cover strips 4A, 4B under the intermediary of screws or bolts 5, the inner ends of which are threaded into a section 1 and/or spacers 6 that determine the spacing or separation between the cover strips 4 and the sections 1. The spacers 6, through which the screws 5 can pass, are suitably fabricated of plastic or the like and may either have the shape of sleeves or be comprised of more or less longitudinal blocks. The reference numerals 8 and 9 designate seals or gaskets, for example of rubber or silicone material, between the triple pane windows 2, 3 and the inner sections 1 and cover strips 4, respectively. The internal space 10 between the glass pane windows 2, 3 which surrounds the spacers 6 is open towards the glass panes 2, 3 and performs the function of allowing air to circulate and water to be drained out of the wall or roof construction to the ambient air (not indoors) through apertures in low points (not shown).

To solve the problem of leakage and provide a durable seal in composite constructions of the kind in question there is utilized, in accordance with the invention, strips, bands or similar larger or smaller pieces of a cloth or foil of rubber, plastic or an analogous liquid-tight and ductile material. These sealing pieces which, in the following description, are designated "strips of rubber or the like" without regard to their shape and which may be fabric or fibre reinforced, are designated by the reference numerals 11 and 12 in FIGS. 2 and 3.

The strips 11, 12 of rubber or the like are applied to the upper side (i.e. the outside) of the inner sections 1A, 1B with extensive mutual overlappings at joining edges, junctions and the like before the mounting of the glass windows 2, 3, spacers 6 and cover strips 4. The strips 11, 12 are thus well protected from UV-radiation, etc. The strips 11, 12 of rubber or the like may be loosely applied or, alternatively, glued or vulcanized to their base or support (inner sections 1A, 1B and strip 12 in FIG. 2).

In FIGS. 2 and 3 it should be noted that those areas of the inner sections 1 which are covered by the strips 11, 12 of rubber or the like are substantially planar and smooth, so that the strips may cross junctions and crevices in a planar manner at junction and intersection points and thereby create and retain a seal even if their support or base moves. From FIGS. 2 and 3 it is also apparent that the strips 11, 12 of rubber or the like form a seal between the spacers 6 and the inner sections 1.

The strips 11, 12 of rubber or the like may have substantially the same extension as the inner sections 1 and may even overlap the sections 1 at their edges, a waste of strip material, since the essential thing is that the strips suitably cover crevices and the like at intersection and junction points. Although the sealing means have been described as strips, they may for example be formed as cross-shaped (like "+") at intersection points or as T-shaped at junction points, at the ends of the inner sections 1, and so forth.

The strips 11, 12 of rubber or the like may be applied in one or more layers, as is apparent from FIGS. 2 and 3. The thickness of the strips is suitably comprised as between 0.2 and 2.0 mm, preferably below 1.0 mm. A thickness of 0.5 to 0.7 mm has been found to be suitable.

The embodiment described above and illustrated in the drawings is, of course, to be regarded merely as a non-limiting example and may as to its details be modified in several ways within the scope of the following claims. In particular, the form, the material and the shape of the strips 11, 12 may deviate from the specifications described hereinabove by way of example. Thus, if the strips are applied in two superimposed layers, the respective layers may be fabricated of different materials. Furthermore, the inner sections 1 and/or the cover strips 4 may be formed of another material, as for example steel, copper, bronze or wood, instead of aluminum as described hereinabove. Furthermore, the triple pane glass windows 2, 3 may, within the scope of the invention, be replaced by single or double pane glass windows or by plates or panels of a weather-durable (i.e. artificial) material, particularly roofing tiles or facade panels of different kinds.

What I claim is:

1. An outer wall or roof construction system comprising:

a plurality of wall panels;

first and second internal frame members disposed inwardly of said wall panels for supporting said wall panels, each of said frame members having a surface facing said wall panels and that defines a plane, and said first and second frame members being disposed in abutting relation to each other so that said planes of the frame members define a common plane and said abutting frame members form a crevice therebetween;

an external cover member disposed outwardly of said wall panels and in spaced apart relation to said frame members so that said wall panels are disposed between the cover member and said frame members;

fastener means for securing the cover member to said frame members with said wall panels secured intermediately therebetween; and a sheet-like sealing member comprising a layer of a ductile sealing foil disposed substantially parallel to said common plane of said frame members and covering said crevice formed between said abutting frame members so as to form a weather-tight seal at said internal frame members.

2. The construction system of claim 1, wherein the sheet-like sealing member has a cross-form configuration.

3. The construction system of claim 1, wherein the sheet-like sealing member has a "T-shaped" configuration.

4. The construction system of claim 1 wherein said frame members extend in discrete longitudinal directions.

5. An outer wall or roof construction system in accordance with claim 1, wherein said first and second frame members are disposed in substantially perpendicular relation to each other.

* * * * *